United States Patent [19]

Roll et al.

[11] 4,006,785

[45] Feb. 8, 1977

[54] POWER TOOL

[75] Inventors: Karl Roll, Leinfelden; Klaus-Peter Fritschi, Merklingen, both of Germany

[73] Assignee: Robert Bosch G.m.b.H., Stuttgart, Germany

[22] Filed: Nov. 12, 1975

[21] Appl. No.: 631,187

[30] Foreign Application Priority Data

Dec. 19, 1974 Germany ..... 2460072

[52] U.S. Cl. ..... 173/12; 192/150

[51] Int. Cl.[2] ..... B25B 23/14

[58] Field of Search ..... 173/12; 81/52.4 A; 192/150

[56] References Cited

UNITED STATES PATENTS

| | | | |
|---|---|---|---|
| 3,288,258 | 11/1966 | Taylor | 192/150 |
| 3,289,715 | 12/1966 | Groff et al. | 192/150 X |
| 3,515,251 | 6/1970 | Clapp | 173/12 X |
| 3,693,381 | 9/1972 | McGee | 81/52.4 A X |
| 3,811,513 | 5/1974 | Wezel et al. | 173/12 |

*Primary Examiner*—Ernest R. Purser
*Assistant Examiner*—William F. Pate, III
*Attorney, Agent, or Firm*—Michael J. Striker

[57] ABSTRACT

A clutch connects the drive motor to the rotatable tool holder. The driven part of the clutch has a plurality of clutch recesses bounded by sloping clutch ridges, with clutch balls received in the recesses. An annular pressure body surrounds the driving part and is pressed by a threshold-torque-determining spring against the clutch balls to hold them in their recesses. When the clutch torque exceeds the threshold value, the clutch balls rise out of the clutch recesses and slip over the respective clutch ridges into the respective adjoining clutch recesses. In so doing, they briefly push back the annular pressure body. This causes the annular pressure body to drive locking balls radially inward through registering radial openings in the driving part and in a locking bolt interior to the latter. When the inner locking ball moves completely into the locking bolt, locking between the driving part and locking bolt terminates. Then, a locking spring which previously participated in the locking action by urging the locking balls radially outward can shift the locking bolt axially relative to the driving part in a sence causing a release valve device to close and terminate energization of the power tool drive motor.

10 Claims, 7 Drawing Figures

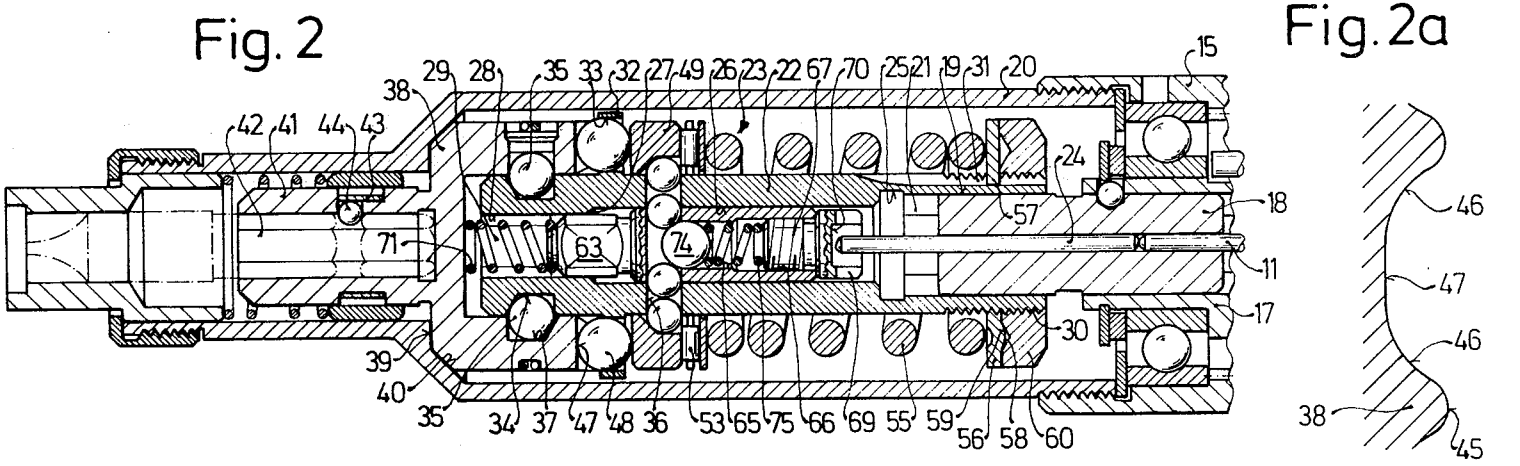
Fig. 2a
Fig. 2
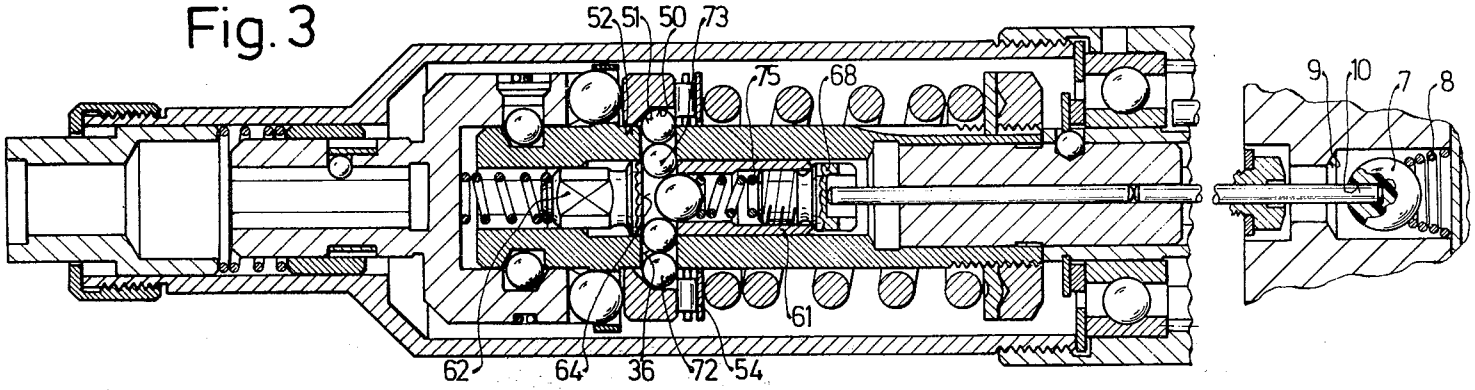
Fig. 3

POWER TOOL

BACKGROUND OF THE INVENTION

The invention relates to power tools, particularly to pneumatically driven power screwdrivers of the type provided with means for monitoring the torque transmitted from a motor built into the power tool to a tool holder at the output of the tool. Arranged intermediate the drive motor and the tool holder is a clutch arrangement. The clutch arrangement is longitudinally shiftable together with the tool holder. The driven part of the clutch has a plurality of clutch depressions bounded by sloping clutch ridges. The clutch includes clutch elements, such as clutch balls, located in the clutch depressions. An axially shiftable pressure body surrounds the driving part of the clutch. Adjustable-stress spring means causes the pressure body to urge the clutch elements to the bottoms of the clutch depressions. The driving and driven parts of the clutch are immovable relative to each other in axial direction; however they are rotatable relative to each other when the torque transmitted by the clutch reaches a predetermined value causing the clutch elements to climb up the associated sloping clutch ridges out of the clutch depressions. Guided in the interior of the driving part of the clutch for axial movement relative to the driving part is a locking bolt coupled to transmit force to a release valve device when the locking bolt is axially moved. The release valve device blocks and unblocks an energy supply conduit leading to the drive motor.

In a known power tool of this construction the clutch elements are clutch balls and the pressure body is a pressure plate. Also, the clutch arrangement simultaneously serves to hold the tool, e.g., a screwdriver element or the like. The driving part of the clutch has a plurality of radial bores. Locking balls are arranged inside these radial bores and bear upon the surface of the locking bolt. The locking bolt is provided with a conical surface which pushes the locking balls radially outward into depressions on the pressure plate. The positions of the locking balls are fixed when they are received within these depressions. The driving part is tube-shaped and connected with the motor via an intermediate shaft. The driving part is provided with an integral flange-shaped disk provided with a plurality of through-passages in which the clutch balls are positioned. The first spring means, which holds the clutch balls in place until the threshold torque is reached, can be a dish spring arrangement.

With this known power tool, when the predetermined threshold torque is reached, the clutch balls rise up the sloping ridges of the clutch depressions on the driven part of the clutch and move completely out of these clutch depressions, so that the driven and driving parts of the clutch become momentarily disengaged. As the clutch balls climb out of their clutch depressions, they push the pressure plate back against the force of the first spring means (the threshold-torque-determining spring), and then slip over into the respective neighboring clutch depressions. However, as soon as the backward shifted pressure plate unblocks the radial bores in the driven part of the clutch, a second spring (the locking spring) causes the locking bolt to press, specifically with its conical surface, against the locking balls so as to force them radially outward into depressions on the pressure plate. Simultaneously, the forwardly shifted locking bolt through the intermediary of a linkage rod closes the rease valve device, thereby causing the drive motor to stop.

With that arrangement, the locking balls must hold the pressure plate against the force of the torque-threshold-determining spring, which presses in opposition through the intermediary of the pressure plate. In certain circumstances this can shorten the useful life of the locking balls and cause excessive wear of the locking edges of the tube-shaped driving part against which the locking balls press.

SUMMARY OF THE INVENTION

It is accordingly a general object of the invention to provide a power tool of the basic construction discussed above, but so designed that the cooperating locking parts which normally lock the locking bolt are not subjected to forces after the clutch balls climb out of their clutch depressions and slip into the respective neighboring clutch depressions, and so designed that an interruption in the power train from the motor to the work tool can be dispensed with.

This object can be met by making the locking bolt non-rotatable relative to the driving part of the clutch and providing the locking bolt with at least one radial bore which can be brought into register with corresponding bores in the driving part of clutch. Arranged in the radial bores are radially shiftable locking elements. The radially outer locking elements are urged by a locking spring, through the intermediary of the radially inner locking elements, into abutment against a radially inward facing surface of the annular pressure body. The inner locking element will normally partially occupy a radial bore of the locking bolt and a registering radial bore of the driving part of the clutch, thereby locking the driving part and the locking bore together for joint axial movement. When the predetermined thresshold torque is reached, the aforementioned clutch balls rise out of their clutch depressions and slip over into their respective neighboring clutch depressions, and in so doing briefly press back the annular pressure body. The pressure body, in so moving back, drives the locking elements radially inward, and the inner locking element in each pair of registering radial bores moves completely into the inner one of the bores, thereby terminating the locking action between the driving part of the clutch and the locking bolt. As a result, the locking bolt is no longer constrained to move axially with the driving part of the clutch, and accordingly force can no longer be transmitted from the driving part via the locking bolt to the spring-loaded release valve device.

Advantageously both the clutch elements and the locking elements are balls.

There can be one radial bore in the locking bolt and one registerable radial bore in the driving part, with the locking spring in such event being disposed radially in the interior of the locking bolt.

Alternatively, the locking spring can be disposed axially and act upon the locking balls through the intermediary of a force-deflecting ball.

As another possibility, there can be a plurality of radial bores in the locking bolt and a corresponding plurality sf registerable radial bores in the driving part of the clutch, with the registering radial bores being provided with radially inner and outer locking balls or other locking elements in the manner described above. In such event, the locking spring can be operative for urging a force-deflecting element in axial direction, with the latter in turn urging the locking elements in the various radial bores radially outward. The force-deflecting element is advantageously a force-deflecting ball. With a plurality of radial bores in the driving part of the clutch and also in the locking bolt, it is advantageous to so dispose them that the forces exerted by the locking spring upon the locking elements in such bores will be balanced with respect to the rotation axis of the tool.

According to a further advantageous concept of the invention, the cluch arrangement is so designed that it is subjected to the biasing force of a recoil spring. Most advantageously, this recoil spring is clamped in between the driven part of the clutch and the locking bolt and has a weaker spring force than the spring force of the spring-loaded release valve device. The purpose of the recoil spring is to offer resistance to the retraction of the tool holder and clutch such as occurs when the tool, e.g., a screwdriver, is pushed against a resisting object, e.g., the head of a screw to be tightened.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 depicts the forward end of the power screwdriver showing the clutch arrangement contained in the forward end, in the rest condition shown in FIG. 1, but on an enlarged scale, and with the release valve device still closed;

FIG. 2*a* depicts a detail of the driven part of the clutch arrangement;

FIG. 3 is a view similar to FIG. 2, but with the power screwdriver in operating position, with the release valve device open;

DESCRIPTION OF THE PREFERRED EMBODIMENTS

Figure 1:
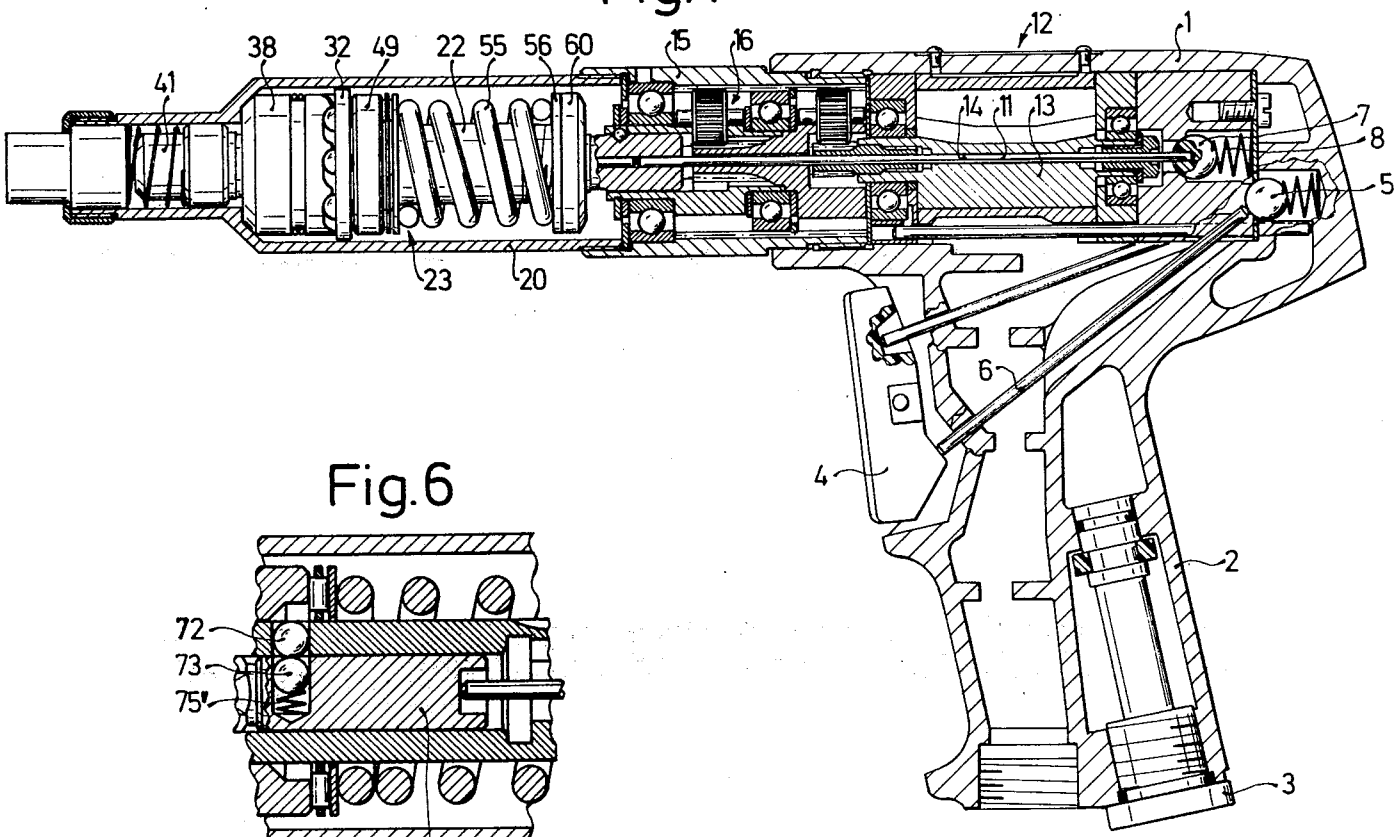
FIG. 1 depicts an exemplary pneumatically driven power screwdriver, in partial sectional view, on a smaller scale than shown in the other Figures, in the starting condition, with the release valve device closed.

The pneumatic screwdriver is comprised of a hand grip 1 which is of one piece with the motor housing 1. Provided in the hand grip 2 is a threaded air connector member 3 and a lever switch 4. Arranged in the rearward part of the motor housing 1 is a turn-on valve 5 which can be activated by the lever switch 4 through the intermediary of a linkage rod 6 and additionally a release switching device comprised of a release valve 7. The release valve 7 is pressed upon a seat 9 by a conical compression spring 8. The release valve 7 is formed as a ball of elastic material which at its forward side is provided with a bore 10 which receives the rear end of a rod 11.

Arranged in the motor housing is a pneumatic sliding-vane motor 12 of per se conventional design whose construction and operation need not be explained in detail. Sliding-vane motor 12 is provided with a rotor 13 having a central, coaxial bore 14.

Screwed into the front end of the motor housing 1 is a pipe-shaped transmission housing 15. Arranged in transmission housing 15 is a two-stage planetary-gear transmission 16 serving to step down the rotary speed of the drive motor. The first planet pinion carrier is provided with a coaxial through-bore for the through-passage of the valve rod 11. The second planet pinion carrier 17 is connected to an intermediate shaft 18, non-rotatable and non-slidable relative to the latter. The front end 19 of intermediate shaft 18 is hexagonally configurated. The intermediate shaft 18 is provided with a central, coaxial through-bore.

The front end 19 of the intermediate shaft 18 projects into a clutch housing 20. The clutch housing 20 is pipe-shaped and screwed into the front end of the transmission housing 15. The hexagonal front end 19 of intermediate shaft 18 is received in the hexagonal recess 21 provided at the rearward end of the sleeve-shaped driving part 22 of a clutch arrangement 23 and is connected non-rotatable relative to driving part 22. The valve rod 11 ends in the interior of intermediate shaft 18. Located forward of valve rod 11 and aligned with the latter in the interior of shaft 18 is a compensating rod 24. The driving part 22 forward of the hexagonal recess 21 thereof is provided with an enlarged transitional bore 25. Forward of this transitional bore 25 the driving part 22 is provided with a smaller-diameter cylindrical bore 26. Cylindrical bore 26 ends in a radially inward extending shoulder 27. Forward of shoulder 27, the interior of driving part 22 terminates as a bore 28 having two guide surfaces 29.

At its exterior, the driving part 22 is of essentially cylindrical configuration. At the region of its rearward end, driving part 22 is provided with an external screwthread 30 which is interrupted by a longitudinal groove 31. In the vicinity of the inner shoulder 27, the cylindrical body of the driving part 22 is exteriorly provided with a flange-shaped disk 32. Flange-shaped disk 32 is provided all around its circumference with a plurality of uniformly distributed axially extending bores 33. Forwardly of the flange-shaped disk 32 there is formed in the outer surface of the driving part 22 a circumferential channel 34. The circumferential channel 34 receives the inner halves of the balls of a radial-axial bearing 35. Rearwardly of the shoulder 27, the driving part 22 is provided with a radially extending transverse through-bore 36.

The balls of the radial-axial bearing 35 extend with their outer halves into an inner circumferential guide channel 37 of a driven part 38 of the clutch arrangement 23. The driven stage 38 is configurated as a cylindrical member surrounding the forward end of the driving part 22. The forward surface 29 of the driven part 38 can abut against a corresponding inner shoulder 40 of the clutch housing 20. Forwardly of its surface 39, the driven part 38 terminates in an integral tool holder 41. The tool holder 41 in order to securely hold a tool is provided with a forward hexagonal recess 42 and a detent ball 44 loaded by an annular spring 43. The driven part 38, at the annular rear face 45 thereof (FIG. 2*a*) surrounding the driving part 22, is provided with a plurality of inclined surfaces 46 together defining a plurality of circumferentially successive circular recesses 47. Resting in these recesses 47 are clutch balls 48 which are guided in the axially extending bores 33 of the flange-shaped disk 32 of the driving part 22. The clutch balls 48 are pressed from the rear by a pressure body which in the illustrated embodiment has the form of a pressure ring 49. At its front and back ends, the pressure ring 49 has flat annular surfaces; its radially outermost peripheral surface is cylindrical. The inner surface of pressure ring 49 is comprised of a rear cylindrical surface 50 and a front conical surface 51 which converges forwardly towards the axis. The frontmost end of the inner surface of pressure ring 49 terminates in a short cylindrical surface 52.

Abutting against the rear end face of pressure ring 49 is a needle bearing 53 designed as an axial bearing. A first spring 55, here a compression spring, bears against the needle bearing 53 through the intermediary of a presure transmitting ring 54. The first compression spring 55 surrounds the cylindrical outer surface of the driving part 22 and is referred to hereinafter as the torque spring. At its rear end, the first spring 55 bears against a stop disk 56. The stop disk 56 is provided with a radially inward extending nose 57 which is engaged in the longitudinal groove 31 in the cylindrical outer surface of the driving part 22 so as to be guided non-rotatable relative to the driving part 22. The rear face of stop disk 56 is provided with raised stop projections 58. Arranged opposed to these raised stop projections 58 are stop recesses 59 provided in an annular nut 60. Annular nut 60 is screwed onto the external thread 30 of the driving part 22. By means of the annular nut 60 the first spring 55 can be stressed to a greater or lesser extent, and accordingly the clutch balls 48 pressed more or less firmly into the recesses 47 of the rear end face 45 of the driven part 38. The cooperating stop projections and recesses 58, 59 secure the position of the annular nut 60 against unintentional turning, and accordingly reliably maintain the turn-off-turque setting of the screw driver.

Guided in the cylindrical bore 26 of the driving part 22 is a cylindrical locking bolt 61. At its front side, the locking bolt 61 is provided with a smaller-diameter shank 62 having two guide surfaces 63. The shank 62 is engaged in the bore 28 of the driving part 22 and, in consequence of the engagement between the guide surfaces 63 and 29, ensures that the locking bolt 61 cannot turn relative to the driving part 22.

At the plane of the radial transverse throughbore 36 of driving part 22, locking bolt 61 has a radial transverse through-bore 64. The through-bore 64 is of the same diameter as and can be brought into register with the through-bore 36. Communicating with the radial transverse through-bore 64 of the locking bolt 61, rearward of the transverse through-bore 64, is a central, coaxial bore 65. Cut into the peripheral surface of bore 65, near the rear end of locking bolt 61, is an internal screwthread 66. The bore 65 is closed off by a screw 67 screwed into the screwthread 66. The screw head 68 of screw 67 has a slit 69 for the insertion of the end of a screwdriver, and furthermore has a cylindrical recess 70. The compensating rod 24 terminates slightly rearward of the bottom of cylindrical recess 70.

Squeezed between the front end of the shank 62 of the locking bolt 61 and the rear end face of the driving part 38 is an axially oriented compression spring 71 (clutch recoil spring). Spring 71 is weaker than the conical compression spring 8 of the release valve 7. Guided in the registerable transverse bores 64 and 36, of the locking bolt 61 and of the driving stage 22, respectively, are two outer locking balls 72 and, radially inward of the latter, two inner locking balls 73. These four locking balls 72, 73 are subjected to pressure exerted upon them by a force-deflecting ball 74. Force-deflecting ball 74 is guided in the central, coaxial bore 65 of the locking pin 61 and is subjected to the action of a compression spring 75 (locking spring) whose rear end bears against the close-off screw 67.

The abovedescribed arrangement operates as follows:

In the inoperative condition of the screwdriver (FIGS. 1 and 2), the clutch arrangement 23 is caused to maintain its forward end position, under the action of the driving part 22, the inner locking balls 73, the locking pin 61, the compensating rod 24, the valve rod 11, the release valve 7 and the valve spring 8.

Next, assume that the tool (e.g., the screwdriver shown in FIG. 1 in dash-dot lines as being held in the tool holder 41) is engaged. In the case of a screwdriver, this would mean that the screwdriver is brought to bear against the screw to be tightened. As a result, the clutch arrangement 23 will be shifted rearward against the resistance of the valve spring 8, and the release valve 7 will be opened and let the motor 12 start up (FIG. 3). The motor 12 will turn the intermediate shaft 18 through the intermediary of the planetary gear transmission 16, and the intermediate shaft 18 will turn the driving part 22, whose flange-shaped disk 32 will by means of the clutch balls 48 cause the driven part 38 to share in the rotary movement.

Figure 4:
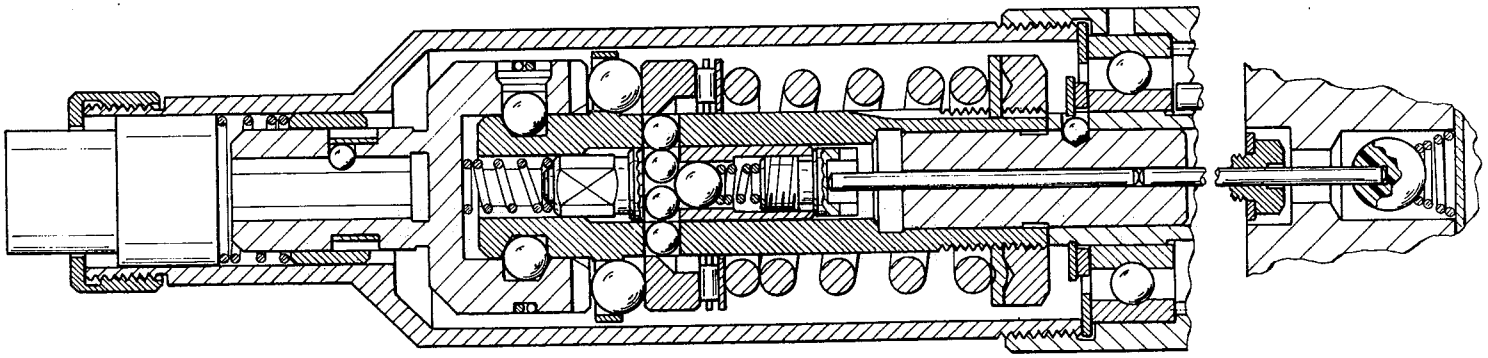
FIG. 4 is a view similar to FIGS. 2 and 3, but showing the moment of operation at which the threshold torque has been reached, and at which the clutch balls 48 have risen out of the clutch depressions 47 and are on the verge of slipping into the respective adjoining clutch depressions 47, with the release valve device still open.
Figure 5:
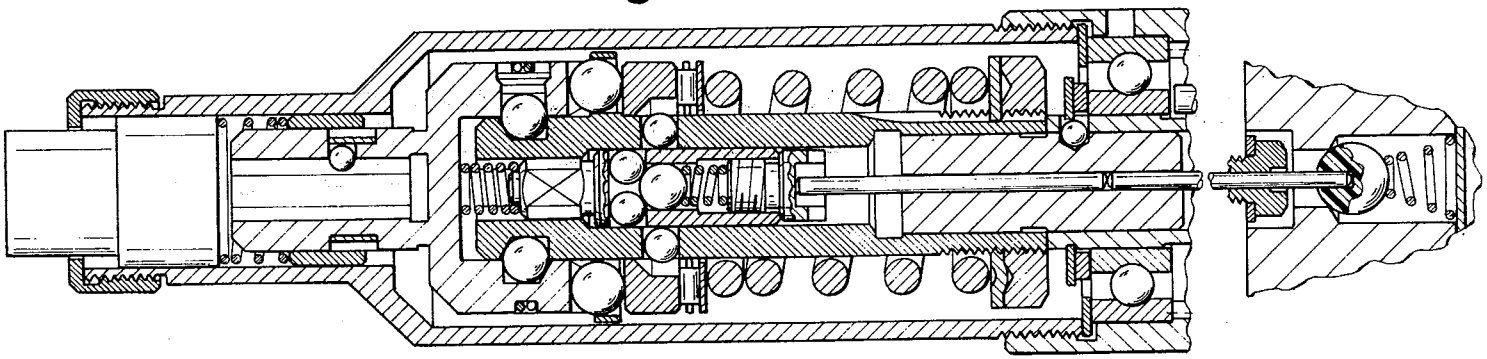
FIG. 5 is a view similar to FIGS. 2–4, after the clutch balls 48 have slipped into the respective adjoining clutch depressions in response to exceeding of the threshold torque, with the locking bolt release and forwardly shifted, and the release valve device now closed.

If the screw (or other threaded members) has been tightened to such an extent that the torque exerted upon the tightened screw by the screwdriver approaches the release torque for which the annular nut 60 has been set, then, as depicted in FIG. 4, the clutch balls 48 climb up the inclined surfaces 46 (FIG. 2a) of the recesses 47 in the rear end face of the driven part 38. As the clutch balls 48 climb out of the recesses 47, they push the pressure ring 49 rearward, causing increasing stressing of the compression spring (torque spring) 55. As the pressure ring 49 is pushed back in this way, it drives the outer locking balls 72 radially inwards into the radial transverse through-bore 36 of the driving part 22. As a result, the inner locking balls 73 move radially inward. These inner locking balls 73 move completely out of the transverse through-bore 36 of the driving part 22 and completely into the locking bolt 61. This movement of the locking balls 73 radially inward causes the force-deflecting ball 74 to move rearward against the force of the locking spring 75.

As a result, the inner locking balls 73 can no longer exert any locking action; the valve spring 8 closes the release valve 7 and, by means of the valve rod 11 and compensating rod 24, shifts the locking bolt 61 forward, so that the inner locking balls 73 are completely contained within the cylindrical longitudinal bore 26 of the driving part 22. The clutch balls 48 have meanwhile each slid over a respective hump 46 and fallen into place in the respective next-following recess 47. Because the release valve 7 is closed, the motor 12 does not operate.

Assume next that the pneumatic screwdrive is pulled back away from the screw to be tightened. The clutch recoil spring 71, inasmuch as it is bears via the locking bolt 61, the compensating rod 24, the valve rod 11 and the release valve 7 upon the stronger valve spring 8, pushes the driven part 38 and accordingly the entire clutch arrangement 23 back into the forward end position. As a result, the radial bores 36 of the driving part 22 move back into register with the radial bores 64 of the locking bolt 61, the locking spring 75 pushes the force-deflecting ball 74 forwards, the latter presses the inner locking balls 73 into the boundary surface between the locking bolt 61 and the driving part 22 and the outer locking balls 72 into abutment against the inner surface of the pressure ring 49. As a result, the starting position illustrated in FIGS. 1 and 2 is reassumed, and the screwdriver is ready for the performance of a new operating cycle.

Figure 6:
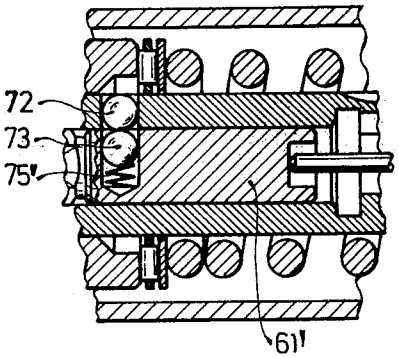
FIG. 6 depicts a detail of the clutch arrangement of the pneumatically driven power screwdriver with a different design for the locking means which locks together the driven part of the clutch and the locking bolt.

Instead of two radial bores in the driving part 22 and locking bolt 61, it would be possible to make use of only one such radial bore, with the locking spring 75 in such event then moving the locking balls, by means of a force-deflecting ball, to only one side. Furthermore, use could be made of a single radial bore, with the locking spring 75' not being axial but instead radially oriented, as depicted in FIG. 6. Finally, use could be made of three or four symmetrically disposed radial bores, with the disposition of bores and parts being advantageously such that the forces exerted upon the locking elements (e.g., upon the locking balls) would be in equilibrium relative to the rotation axis of the tool.

An advantage of the abovedescribed arrangement is that the locking balls and the locking edges on the driving part and locking bolt are not subjected to the large forces to which the torque spring is subjected, but instead are subjected only during a switchover to the small forces exerted by the valve spring. As a result of this, reliable operation and little wear are assured even over very long periods of use.

It will be understood that each of the elements described above, or two or more together, may also find a useful application in other types of constructions differing from the types described above.

While the invention has been illustrated and described as embodied in a in a hand-held power tool, particularly a screwdriver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power tool, particularly a hand-held pneumatically driven power screwdriver or other hand-held power tool, comprising, in combination, a tool housing, a drive motor in the housing, a spring-loaded release valve device arranged in an energy supply conduit leading to the motor for blocking and unblocking the energy supply conduit, a tool holder rotatably mounted at the front of the housing, a clutch including a hollow driving part connected to the motor and a driven part connected to the tool holder, the clutch being axially shiftable together with the tool holder, the driven part having a plurality of clutch depressions bounded by sloping clutch ridges, the clutch including clutch elements located in the clutch depressions, the clutch including an axially shiftable pressure body surrounding the driving part, adjustable-stress first spring means causing the pressure body to urge the clutch elements to the bottoms of the clutch depressions, the driving and driven parts being immovable relative to each other in axial direction, the driving and driven parts becoming rotatable relative to each other when the torque transmitted by the clutch reaches a predetermined value causing the clutch elements to climb up the associated sloping clutch riges and out of the clutch depressions, the clutch further including a locking bolt guided in the interior of the driving part for axial movement relative to the driving part and being coupled to transmit force to the release valve when axially moved, the locking bolt being guided in the driving part nonrotatable relative to the latter and having at least one radial bore, the driving part having at least one radial bore which can be brought into register with the radial bore of the locking bolt, the clutch further including at least one outer and one inner radially shiftable locking element in the radial bores the inner one of which serves when the bores are in register for locking the driving part and the locking bolt together for joint axial movement so that axial movement of the clutch in response to axial movement of the tool holder causes the locking bolt to transmit force from the driving part to the spring loaded release valve device, the pressure body having a cam surface which faces towards the driving part, the clutch further including second spring means operative for causing the inner locking element to urge the outer locking element radially outward into abutment against the cam surface, the cam surface being so configurated that when the clutch elements climb out of the clutch recesses and push back the pressure body against the opposition of the first spring means the cam surface of the pressure body drives the locking elements radially inward to a position in which the locking elements no longer lock the driving part and locking bolt together for joint axial movement, whereby the locking bolt can no longer transmit axial force from the clutch to the release valve.

2. The power tool defined in claim 1, wherein the clutch elements are clutch balls.

3. The power tool defined in claim 1, wherein the locking elements are locking balls.

4. The power tool defined in claim 1, wherein the second spring means is arranged in the radial bore of the locking bolt.

5. The power tool defined in claim 1, wherein the second spring means comprises a locking spring arranged in the interior of the locking bolt coaxial with the rotation axis of the tool and a force-deflecting element intermediate the locking spring and the inner locking element for converting the axial force exerted by the locking spring into a radially outward force exerted upon the inner and outer locking elements.

6. The power tool defined in claim 1, wherein the driving part and the locking bolt are each provided with a plurality of such radial bores, with the radial bores of the driving part being movable into simultaneous register with the radial bores of the locking bolt, with the inner and outer locking elements being located in one pair of registering radial bores and with further inner and outer locking elements being located in the at least one further pair of registering radial bores, wherein the second spring means comprises a locking spring arranged in the interior of the locking bolt coaxial with the rotation axis of the tool and a force-deflecting element intermediate the locking spring and the inner locking element for converting the axial force exerted by the locking spring into a radially outward force exerted upon the inner and outer locking elements in all pairs of registering radial bores.

7. The power tool defined in claim 5, wherein the force-deflecting element is a force-deflecting ball.

8. The power tool defined in claim 6, wherein the plurality of pairs of registering outer and inner radial bores are disposed symmetrically with respect to the rotation axis of the tool so that the forces exerted via the force-deflecting element by the locking spring and transmitted to the locking elements in the registering radial bores will be in balance.

9. The power tool defined in claim 1, wherein the tool further includes recoil spring means operative for resisting retraction of the tool holder and cluch when the tool holder is pressed against an object.

10. The power tool defined in claim 9, wherein the recoil spring means is clamped between the driven part of the clutch and the locking bolt and has a spring force less than the spring force of the spring-loaded release valve device.

* * * * *